US011060347B2

(12) United States Patent
Hsu et al.

(10) Patent No.: US 11,060,347 B2
(45) Date of Patent: Jul. 13, 2021

(54) WINDOW SHADE ASSEMBLY

(71) Applicants: Sheng Ying Hsu, Changhua County (TW); Chun Jan Hsu, Changhua County (TW)

(72) Inventors: Sheng Ying Hsu, Changhua County (TW); Chun Jan Hsu, Changhua County (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 302 days.

(21) Appl. No.: 16/245,592

(22) Filed: Jan. 11, 2019

(65) Prior Publication Data

US 2019/0345761 A1 Nov. 14, 2019

(30) Foreign Application Priority Data

May 11, 2018 (TW) ..... 107206208

(51) Int. Cl.
*E06B 9/322* (2006.01)
*E06B 9/323* (2006.01)

(52) U.S. Cl.
CPC ..... *E06B 9/322* (2013.01); *E06B 9/323* (2013.01)

(58) Field of Classification Search
CPC .. E06B 9/322; E06B 9/323; E06B 2009/3222; E06B 2009/785; E06B 9/16; E06B 9/40
See application file for complete search history.

(56) References Cited

U.S. PATENT DOCUMENTS

| | | | | |
|---|---|---|---|---|
| 9,062,494 | B2 * | 6/2015 | Chen | E06B 9/60 |
| 10,501,988 | B2 * | 12/2019 | Fisher | E06B 9/62 |
| 2012/0152470 | A1 * | 6/2012 | Chen | E06B 9/42 160/292 |
| 2013/0153161 | A1 * | 6/2013 | Haarer | E06B 9/60 160/293.1 |
| 2014/0262068 | A1 * | 9/2014 | Buccola, Jr. | E06B 9/322 160/120 |
| 2016/0356081 | A1 * | 12/2016 | Sung | E06B 9/306 |
| 2016/0376839 | A1 * | 12/2016 | Huang | E06B 9/323 160/368.1 |
| 2018/0010384 | A1 * | 1/2018 | Huang | E06B 9/322 |
| 2018/0044980 | A1 * | 2/2018 | Hsu | A47H 23/01 |
| 2018/0179812 | A1 * | 6/2018 | Dubina | E06B 9/42 |
| 2019/0211622 | A1 * | 7/2019 | Kao | E06B 9/78 |

* cited by examiner

*Primary Examiner* — Beth A Stephan
(74) *Attorney, Agent, or Firm* — Che-Yang Chen; Law Office of Michael Chen

(57) ABSTRACT

A window shade assembly includes a top box with two end members respectively connected to two ends of the top box, a shaft, a shade and a scrolling unit. The scrolling unit is received in the shaft and located between the two end members. The scrolling unit includes two end parts, a head, a spring and a movable member. By rotating the head to activate the spring to store a scrolling force, such that when pulling the shade, the end part drives the shaft to rotate and lower the shade. The spring does not pulls the shade upward and keeps its scrolling force at a level. When the shade is pushed upward, the shade is lifted automatically.

11 Claims, 8 Drawing Sheets

FIG..8a

WINDOW SHADE ASSEMBLY

BACKGROUND OF THE INVENTION

1. Fields of the Invention

The present invention relates to a window shade assembly wherein the shade is moved and stay at a desired position without using operation cords.

2. Descriptions of Related Art

The conventional window shade assemblies are controlled by operational cords which are exposed beside the shade, and the exposed operational cords become a concern of safety to children.

A cordless window shade assembly is then developed which uses coil springs to adjust the position of the shade. However, the coil spring includes some problems which are that the recovery force of the coil spring is significant so that when the shade is lifted a small distance, the shade cannot stay at that position and will return to the initial position. Therefore, multiple weights are installed to the bottom rail of the shade to overcome the problem, and the weights increase manufacturing cost. Besides, the assembling processes are complicated and has low efficiency.

The present invention is intended to provide a scrolling unit for a window shade assembly, and the scrolling unit resolves the drawbacks mentioned above.

SUMMARY OF THE INVENTION

The present invention relates to a window shade assembly and comprises a top box having a passage defined axially therethrough, and two end members are respectively connected to two ends of the top box. Each of the two end members has a board from which an insertion and a seat respectively extend. The two respective insertions are inserted into the passage from the two ends of the top box. A shaft is a hollow shaft and includes two open ends, and a space is defined in the shaft. The two respective seats of the two end members are respectively inserted into the two open ends of the shaft. The shaft has multiple ridges extending axially from the inner periphery thereof, and a slot is defined axially in the outer periphery of the shaft. A shade is scrolled onto the shaft and has the first end secured and engaged with the slot of the shaft, and a bottom rail is connected to the second end of the shade.

A scrolling unit is located in the space and between the two seats. The scrolling unit includes two end parts, a head, a spring and a movable member. The end parts each have a tubular portion and a hole defined through the end part. Multiple first grooves are defined axially in the outer periphery of the tubular portion and located corresponding to the ridges. The two respectively tubular portions are respectively inserted into the two open ends of the shaft, and the two respective seats of the two end members are inserted into the two respectively holes of the two end parts. The head is connected to the hole of one of the end parts and connected to a rod. The spring is mounted to the rod. The movable member includes a seal part and multiple second grooves which are located corresponding to the ridges. The spring has the first end mounted to the seal part and stopped by the movable member, and the second end of the spring contacts the one of the end parts. The scrolling unit generates a scrolling force when the head is rotated so as to adjust the shade.

Preferably, the present invention is connected with a driving member which is controlled by a controller. The controller drives the driving member to control the operation of the shaft so as to lift or lower the shade. The controller controls the driving member by any known methods.

The advantages of the present invention are that the spring controls the scrolling force to the shade. The number of coils of the spring is pre-set to provide desired scrolling force.

The cord unit can be connected to the end part that is located away from the head to control the window shade assembly that is located at a higher position.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 8*a* shows that a driving member is connected to the window shade assembly of the present invention.

DETAILED DESCRIPTION OF THE PREFERRED EMBODIMENT

Figure 1:
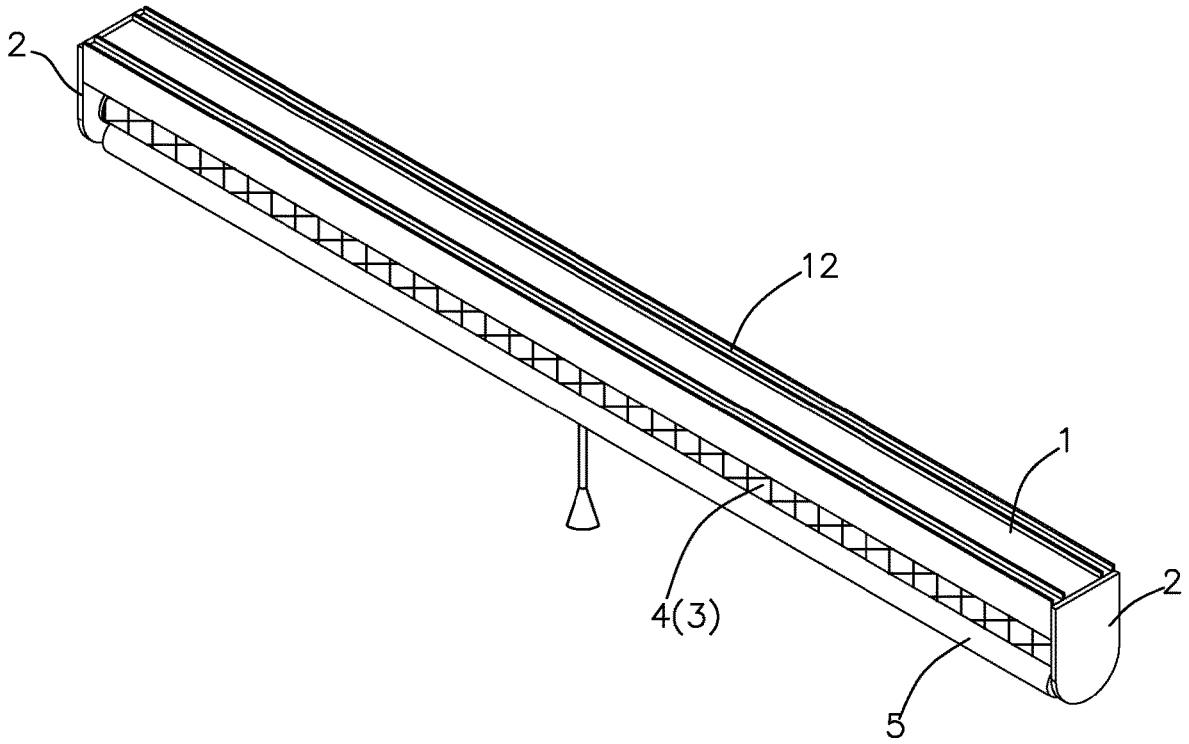
FIG. 1 illustrates the window shade assembly in its folded status.
Figure 2:
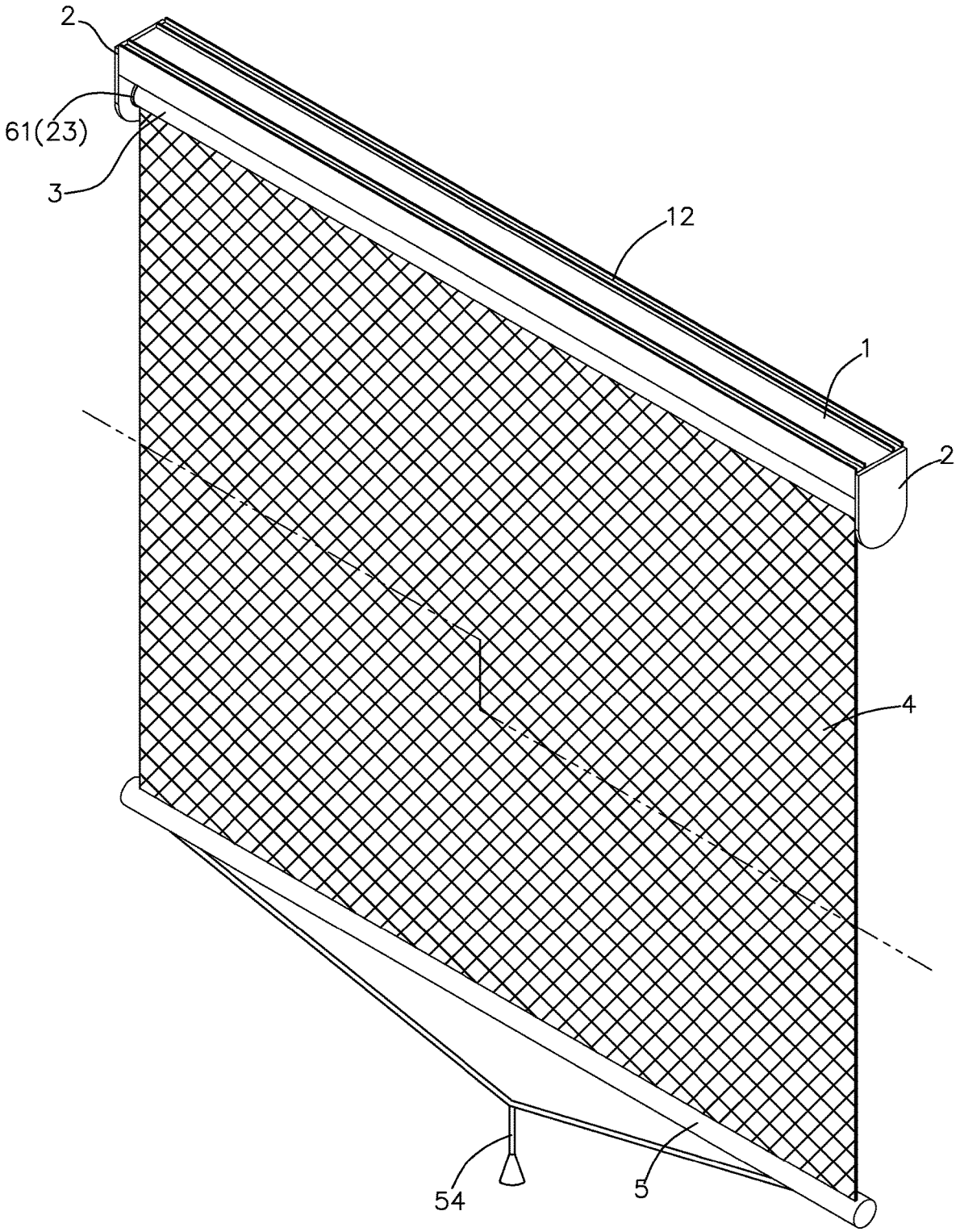
FIG. 2 illustrates the window shade assembly in its expanded status.
Figure 3:
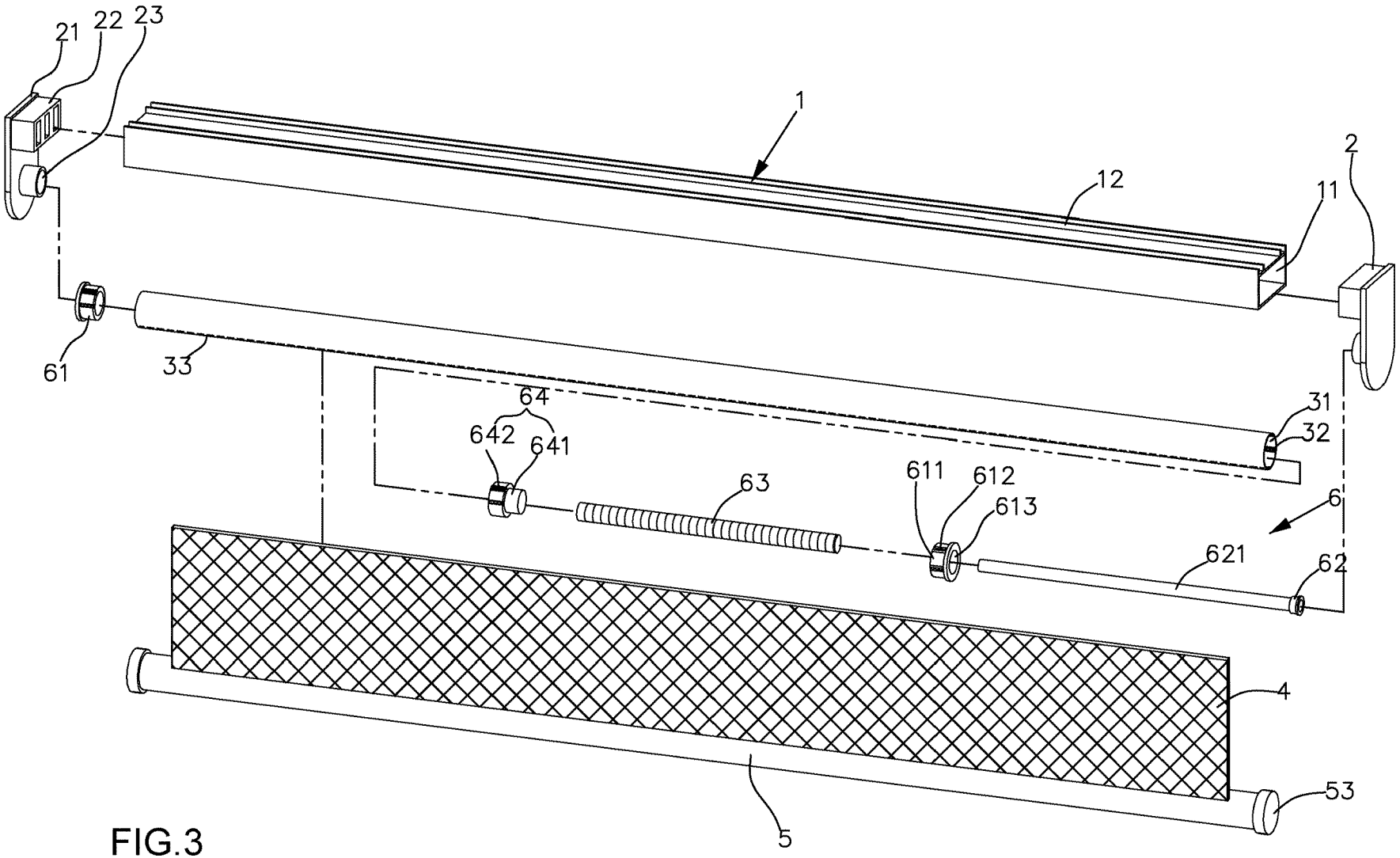
FIG. 3 is an exploded view of the window shade assembly of the present invention.
Figure 4A:
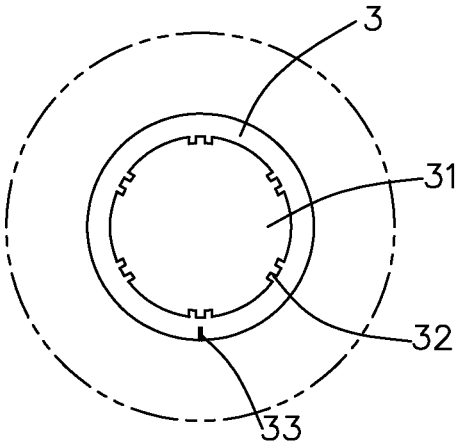
FIG. 4*a* is an end view of the shaft of the window shade assembly of the present invention.
Figure 4B:
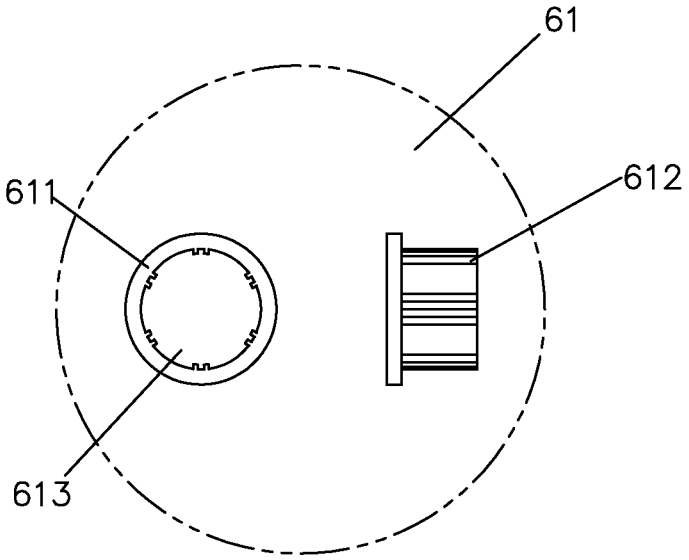
FIG. 4*b* is an enlarged view to show the end part of the window shade assembly of the present invention.
Figure 5A:
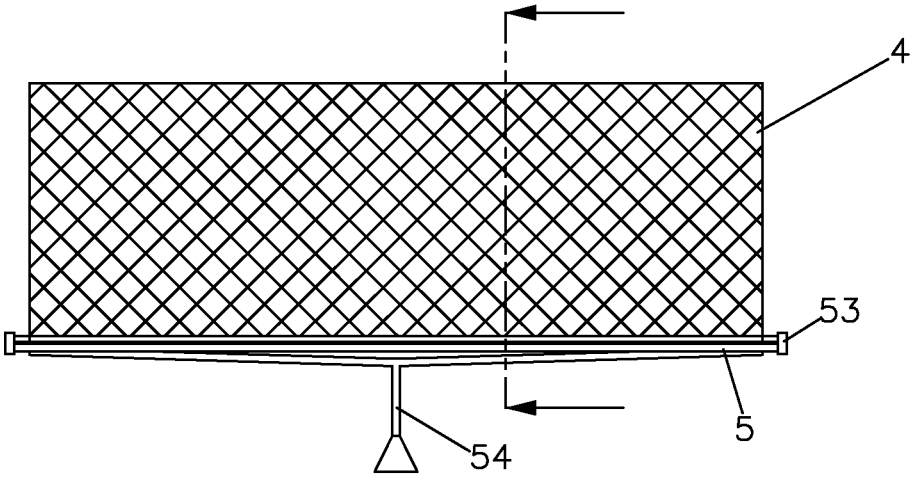
FIG. 5*a* shows the shade and the pull member of the window shade assembly of the present invention.
Figure 5B:
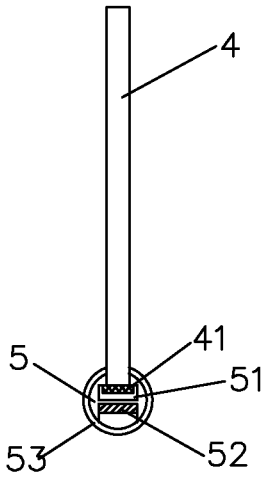
FIG. 5*b* shows a side cross sectional view of the shade and the pull member of the window shade assembly of the present invention.
Figure 6A:
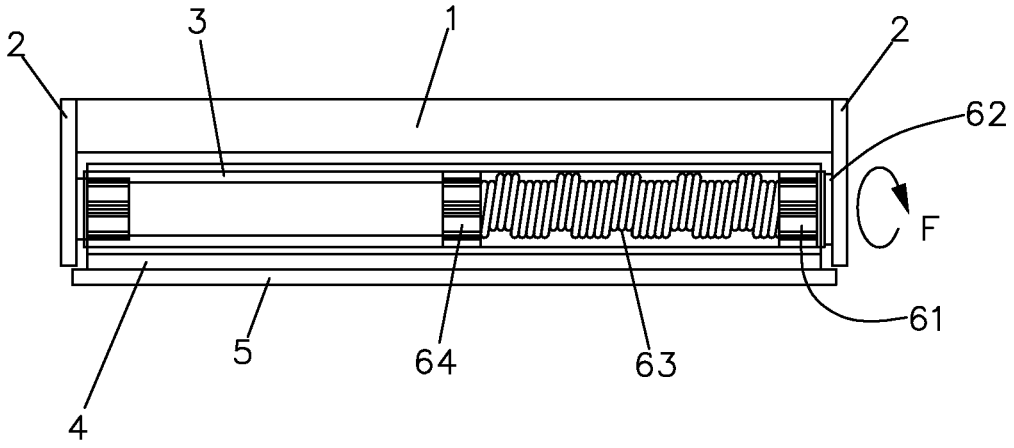
FIG. 6*a* shows that the spring is activated to store the scrolling force.
Figure 6B:
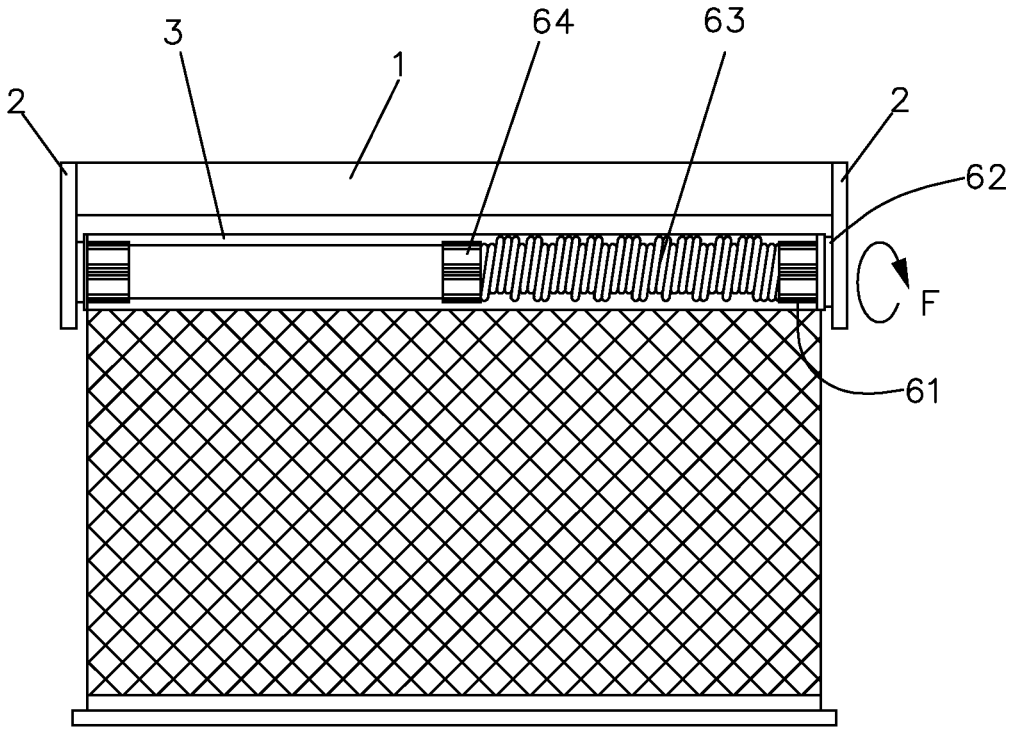
FIG. 6*b* shows that the shade is pulled downward.

Referring to FIGS. 1 to 6*b*, the window shade assembly of the present invention comprises a top box 1 having a passage 11 defined axially therethrough, and two end members 2 are respectively connected to two ends of the top box 1. The two end members 2 are identical and each end member 2 is symmetrical relative to the axis thereof. The end members 2 are made by way of plastic injection molding. Each of the two end members 2 includes a board 21, and an insertion and a seat 23 respectively extend from the board 21 of each end member 2. The two respective insertions 22 are inserted into the passage 11 from the two ends of the top box 1. The top box 1 includes a connection face 12 formed on the top thereof so as to be connected to a window frame.

A shaft 3 is a hollow shaft and made of aluminum alloy. The shaft 3 has two open ends, and a space 31 is defined axially in the shaft 3. The two respective seats 23 of the two end members 2 are respectively inserted into two open ends of the shaft 3. The shaft 3 has multiple ridges 32 extending axially from the inner periphery thereof, and a slot 33 is defined axially in the outer periphery of the shaft 3. A shade 4 is scrolled onto the shaft 3 and has the first end thereof secured and engaged with the slot 33 of the shaft 3. A bottom rail 5 is connected to the second end of the shade 4. Specifically, the second end of the shade 4 is connected to a connection plate 41 by way of gluing or stitching. The bottom rail 5 includes a slit 51 which is connected with the connection plate 41. Besides, the bottom rail 5 includes at least one weight 52 received therein, and two caps 53 are respectively connected to two ends of the bottom rail 5. The bottom rail 5 has a pull member 54 connected to the lower end thereof so that the users may pull the member 54 to operate the shade 4.

A scrolling unit 6 is located in the space 31 and between the two seats 23. The scrolling unit 6 includes two end parts 61, a head 62, a spring 63 and a movable member 64. The end parts 61 each have a tubular portion 611 and a hole 613 defined through the end part 61. Multiple first grooves 612 are defined axially in the outer periphery of the tubular portion 611 and located corresponding to the ridges 32. The two respectively tubular portions 611 are respectively inserted into two open ends of the shaft 3 and the two respective seats 23 of the two end members 2 are inserted into the two respectively holes 613 of the two end parts 61. The head 62 is connected to the hole 613 of one of the end parts 61, and the head 62 is connected to a rod 621. The spring 63 is mounted to the rod 621. The movable member 64 includes a seal part 641 and multiple second grooves 642 which are located corresponding to the ridges 32. The spring 63 has the first end mounted to the seal part 641 and stopped by the movable member 64, and the second end of the spring 63 contacts the end part 61. The scrolling unit 6 generates a scrolling force "F" when the head 62 is rotated so as to adjust the shade 4. The shaft 3 is rotated by operation of the end part 61 so that the shade 4 can be moved, and can be stopped at a desired position without using any braking means to position the shade 4.

When the users pulls the shade 4 down to tighten the spring 63, the shade 4 is moved to a desired position and does not automatically moves upward. When the shade 4 is lifted, the scrolling force "F" lifts the 15 shade instantly. Not like the conventional window shade, the users have to move the shade to a position where the shade is lifted by the spring. In other words, the spring 63 always keeps its scrolling force "F" at a level such that the shade 4 can be lifted at any position. The shade 4 is moved silently and does not hit the top box 1 as the conventional shade assemblies using coil springs does.

Figure 7A:
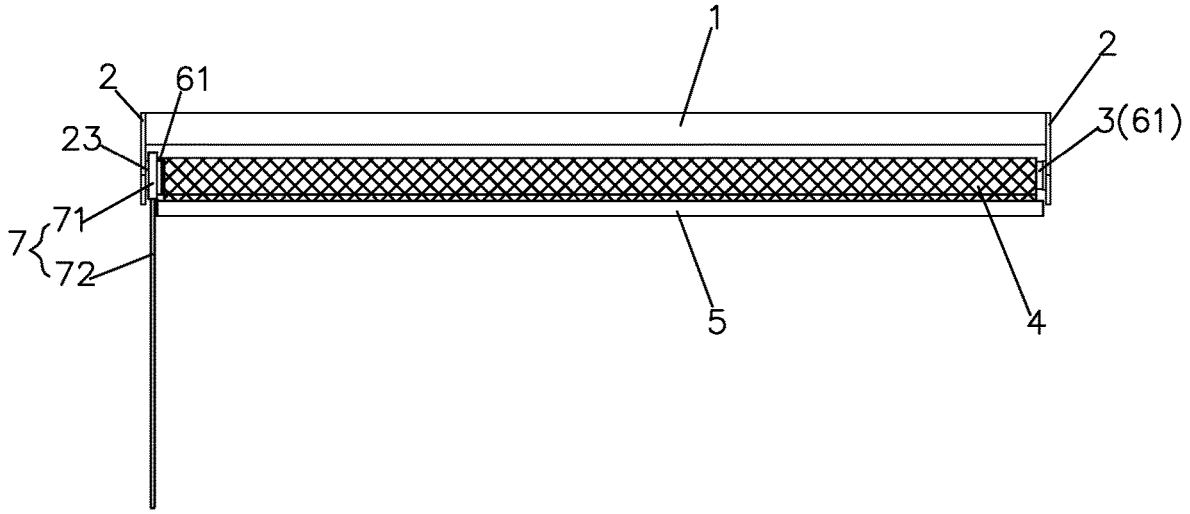
FIG. 7*a* shows that a cord unit is connected to the window shade assembly of the present invention.
Figure 7B:
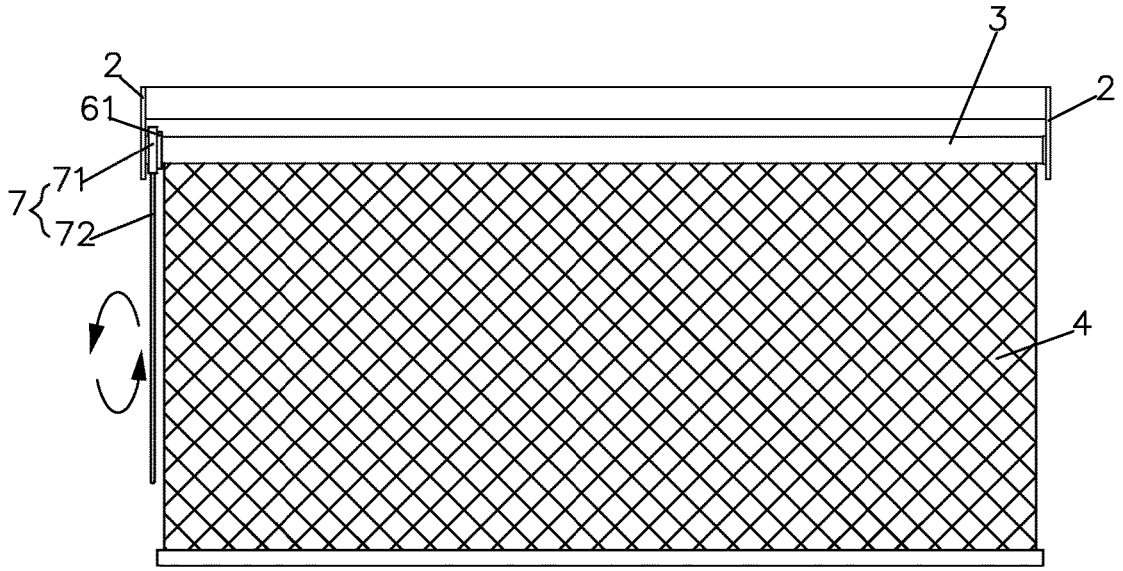
FIG. 7*b* shows the operation of the cord unit to move the shade.

As shown in FIGS. 7*a* and 7*b*, in this embodiment, the end part 61 that is connected to the head 62 is connected with a cord unit 7 which includes a stationary pulley 71 and an operation cord 72. The operation cord 72 is operated to rotate the shaft 3 to move the shade 4. This embodiment is suitable for restaurants or convenient stores that have the windows at higher positions.

Figure 8B:
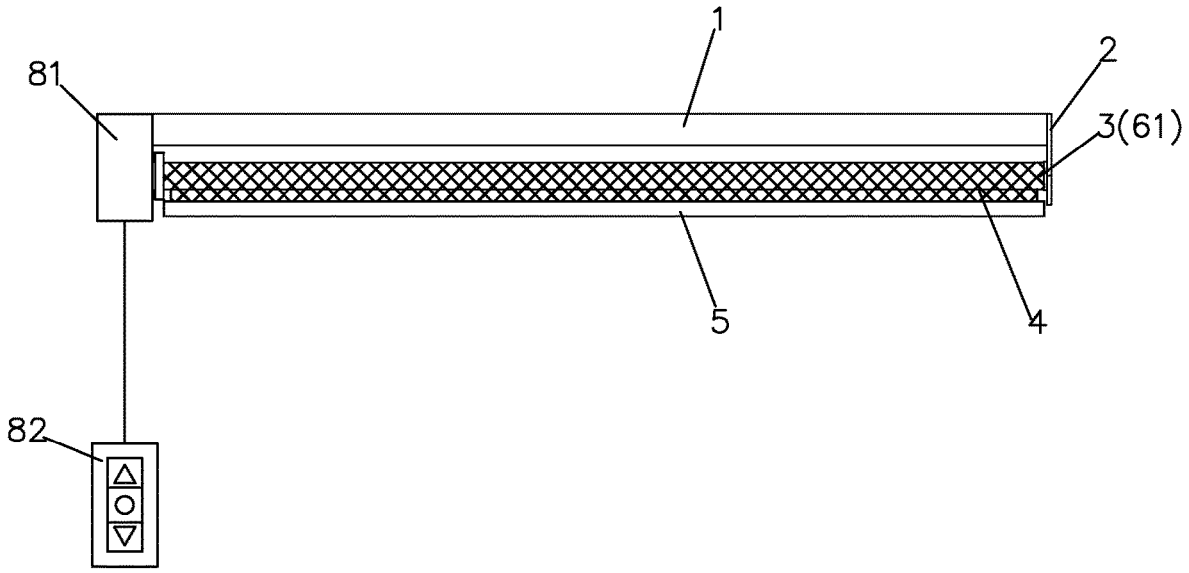
FIG. 8*b* shows that the shade is moved by operation of the driving member.
Figure 8B:
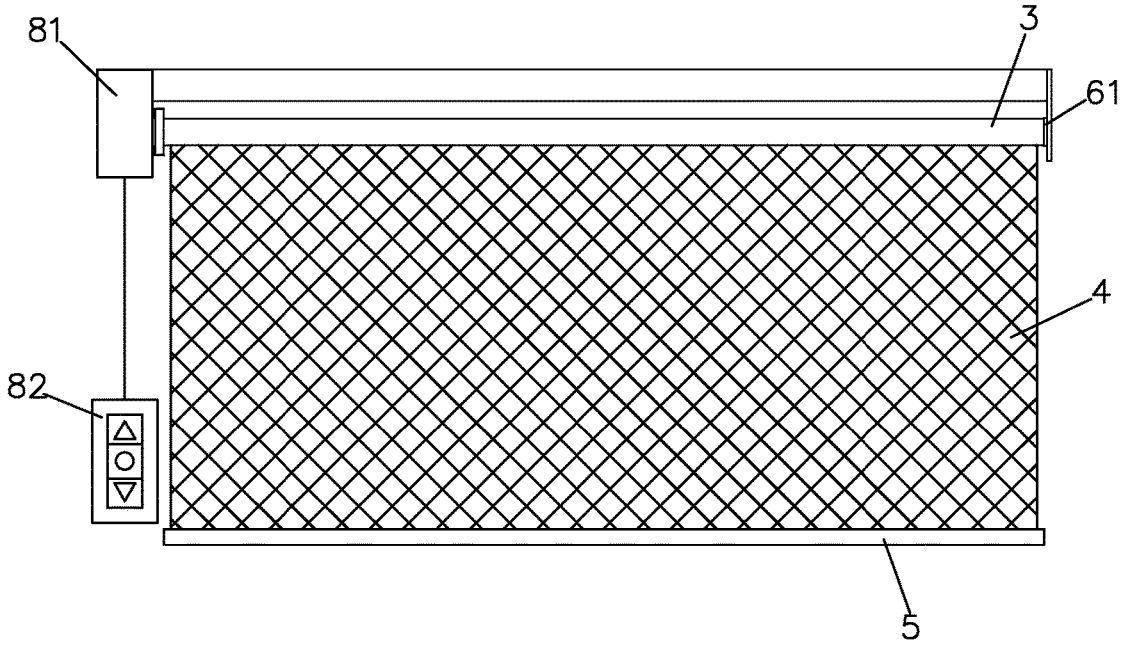

As shown in FIGS. 8*a*, 8*b*, in this embodiment, the end part 61 that is connected to the head 62 is connected with a driving member 81 which is connected to the end part 61 and a controller 82. The controller 82 controls rotation of the shaft 3 to move the shade 4. The controller 82 is connected to the driving member 81 by a cable, or the controller 82 is a wireless controller and controls the driving member 81 by a wireless way.

While we have shown and described the embodiment in accordance with the present invention, it should be clear to those skilled in the art that further embodiments may be made without departing from the scope of the present invention.

What is claimed is:

1. A window shade assembly comprising:

a top box having a passage defined axially therethrough, two end members respectively connected to two ends of the top box, each of the two end members having a board from which an insertion and a seat respectively extend, the two respective insertions inserted into the passage from the two ends of the top box;

a shaft being a hollow shaft and having two open ends, a space defined in the shaft, the two respective seats of the two end members respectively inserted into the two open ends of the shaft, the shaft having multiple ridges extending axially from an inner periphery thereof, a slot defined axially in an outer periphery of the shaft;

a shade scrolled onto the shaft and having a first end secured and engaged with the slot of the shaft, a bottom rail connected to a second end of the shade, and a scrolling unit located in the space and between the two seats, the scrolling unit including two end parts, a head, a spring and a movable member, the end parts each having a tubular portion and a hole defined through the end part, multiple first grooves defined axially in an outer periphery of the tubular portion and located corresponding to the ridges, the two respectively tubular portions respectively inserted into the two open ends of the shaft and the two respective seats of the two end members inserted into the two respectively holes of the two end parts, the head connected to the hole of one of the end parts and connected to a rod, the spring mounted to the rod, the movable member including a seal part and multiple second grooves which are located corresponding to the ridges, the spring having a first end mounted to the seal part and stopped by the movable member, a second end of the spring contacting the one of the end parts, the scrolling unit generating a scrolling force when the head is rotated so as to adjust the shade.

2. The window shade assembly as claimed in claim 1, wherein the top box includes a connection face formed on a top thereof.

3. The window shade assembly as claimed in claim 1, wherein the two end members are identical and each of the two end members is symmetrical relative to an axis thereof, the two end members are made by way of plastic injection molding.

4. The window shade assembly as claimed in claim 1, wherein the shaft is made of aluminum alloy.

5. The window shade assembly as claimed in claim 1, wherein the second end of the shade is connected to a connection plate by way of gluing or stitching, the bottom rail includes a slit which is connected with the connection plate.

6. The window shade assembly as claimed in claim 1, wherein the bottom rail includes at least one weight received therein, two caps are respectively connected to two ends of the bottom rail.

7. The window shade assembly as claimed in claim 1, wherein the bottom rail has a pull member connected to a lower end thereof.

8. The window shade assembly as claimed in claim 1, wherein the end part that is connected to the head is connected with a cord unit which includes a stationary pulley and an operation cord, the operation cord is operated to rotate the shaft to move the shade.

9. The window shade assembly as claimed in claim 1, wherein the end part that is connected to the head is connected with a driving member which is connected to the end part and a controller, the controller controls rotation of the shaft to move the shade.

10. The window shade assembly as claimed in claim 9, wherein the controller is connected to the driving member by a cable.

11. The window shade assembly as claimed in claim 9, wherein the controller is a wireless controller and controls the driving member by a wireless way.

* * * * *